United States Patent [19]

Lutgen

[11] Patent Number: 4,723,997

[45] Date of Patent: Feb. 9, 1988

[54] METHOD AND APPARATUS FOR SHIELDING A STREAM OF LIQUID METAL

[75] Inventor: Noel F. Lutgen, Downers Grove, Ill.

[73] Assignee: L'Air Liquide, Paris, France

[21] Appl. No.: 40,195

[22] Filed: Apr. 20, 1987

[51] Int. Cl.[4] ..... C23B 9/00

[52] U.S. Cl. ..... 75/96; 266/44; 266/207

[58] Field of Search ..... 266/207, 44; 75/96

[56] References Cited

U.S. PATENT DOCUMENTS

| | | | |
|---|---|---|---|
| 3,230,074 | 1/1966 | Roy et al. | 75/49 |
| 3,963,224 | 6/1976 | Pollard | 266/207 |
| 4,089,678 | 5/1978 | Hanawalt | 75/67 A |
| 4,313,596 | 2/1982 | King | 266/44 |
| 4,602,949 | 7/1986 | Rellis | 266/207 |
| 4,614,216 | 9/1986 | Savard et al. | 164/67.1 |
| 4,657,587 | 11/1985 | Savard | 75/96 |
| 4,666,511 | 5/1987 | Naud | 75/51.7 |

*Primary Examiner*—Peter D. Rosenberg

*Attorney, Agent, or Firm*—Lee C. Robinson, Jr.

[57] ABSTRACT

A method for shielding a stream of liquid steel in an ingot mold as well as an installation to use this method. The shielding is done by means of a truncated cone placed around the pouring hole and converging towards the stream of metal, an injection nozzle opening out tangentially near the wide base of the truncated cone and projecting carbon dioxide snow and/or gas obtained by discharging liquid carbon dioxide around the pouring stream.

7 Claims, 11 Drawing Figures

040195

METHOD AND APPARATUS FOR SHIELDING A STREAM OF LIQUID METAL

BACKGROUND OF THE INVENTION

1. Field of the Invention

The present invention relates to a method for shielding a stream of liquid metal against oxidation and/or nitriding when it is being poured from a first receptacle such as a ladle, a distributor, or the like into a second receptacle such as a tundish, an ingot mold, or the like, the pouring stream of liquid metal being surrounded by a screen of shielding gas which prevents or reduces oxidation and/or nitriding by the surrounding atmosphere.

2. Description of the Prior Art

It is known from European Pat. No. EP 154 585 to shield a stream of metal with carbon dioxide, for example during pouring from a ladle into an ingot mold. The ladle is preferably provided with a peforated, circular ring which is located just above the pouring spout and is capable of forming a shielding screen of carbon dioxide gas. The ring is connected to a continuous feeder source of carbon dioxide gas. The installation further comprises conventional equipment to blow out the ingot mold using gaseous carbon dioxide.

It is also known from European Pat. No. EP 196 952 to inert a casting ladle by injecting carbon dioxide snow into the bottom of the ladle before and, if necessary, during the pouring of the metal stream into the ladle.

These two methods pertain more especially to the pouring of a liquid metal into a ladle or an ingot mold and are not directly applicable to continuous casting from a ladle into an oscillating ingot mold, for example. Moreover, the use of gaseous carbon dioxide in the first patent referred to above necessitates vaporizer between the storage of liquid carbon dioxide and the means used to inject gaseous carbon dioxide.

SUMMARY OF THE INVENTION

The object of the present invention is to use liquid carbon dioxide directly in the neighborhood of the stream of molten metal. It relates more especially to a method for shielding a stream of liquid metal by means of liquid carbon dioxide as well as to an apparatus for the use of this method.

According to the method of the invention, the envelope of shielding gas is made by expanding liquid carbon dioxide through a nozzle placed near the wide base of a truncated sleeve surrounding the pouring stream, the said sleeve being fastened by its wide base around the pouring hole of the first receptacle and extending substantially up to the upper opening of the second receptacle, the said nozzle being pointed tangentially with respect to the internal sheath of the said sleeve and delivering a cloud of carbon dioxide snow particles at a speed sufficient to surround the pouring stream in a helical motion directed towards the small base of the sleeve, these snow particles being gradually sublimated upon contact with the heat released by the pouring stream, the carbon dioxide snow particles and the carbon dioxide gas thus created escaping through the lowre end of the sleeve and forming a cone of shielding gas, the opening of which is pointed to the second receptacle and the envelope of which is substantially perpendicular to that of the truncated sleeve.

Preferably, the angle of the truncated cone is substantially within the range of 10° to 30° while the distance from the small base of the truncated cone to the opening of the receptacle is less than or equal to about 30 mm. This distance can be higher if the opening of the second receptacle is reduced by a mask.

BRIEF DESCRIPTION OF THE DRAWINGS

The invention will be better understood from the description of the following modes of embodiment, given as non-exhaustive examples, along with the figures of which.

DESCRIPTION OF THE DISCLOSED EMBODIMENTS

Figure 1A:
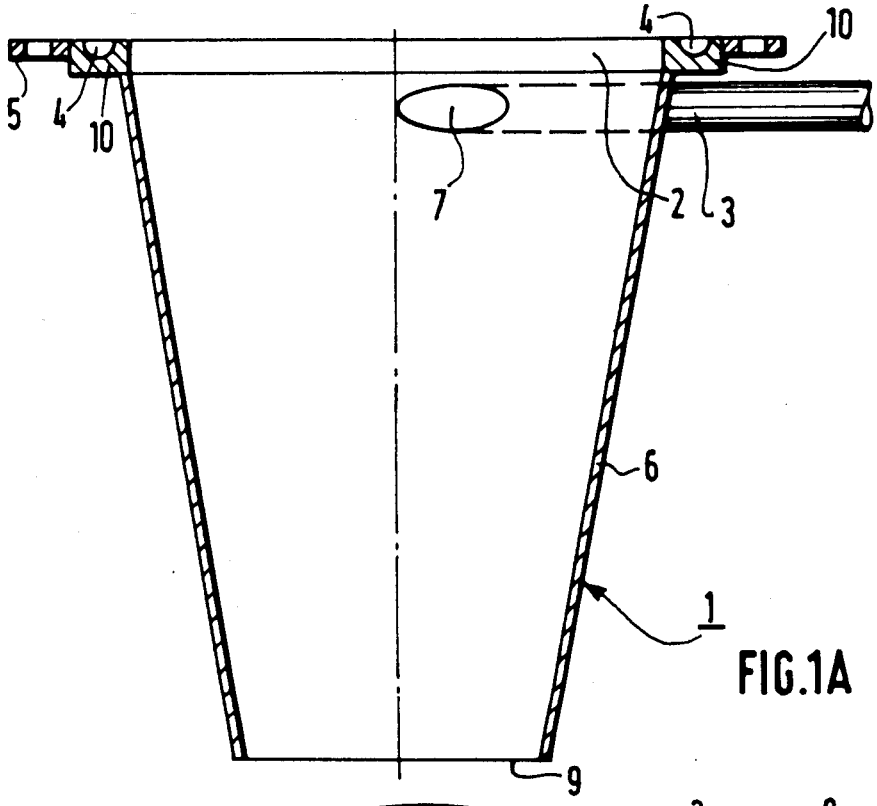
FIG. 1A is a cross-sectional view and FIG. 1B is a top view of a truncated cone used in the method according to the invention.
Figure 1B:
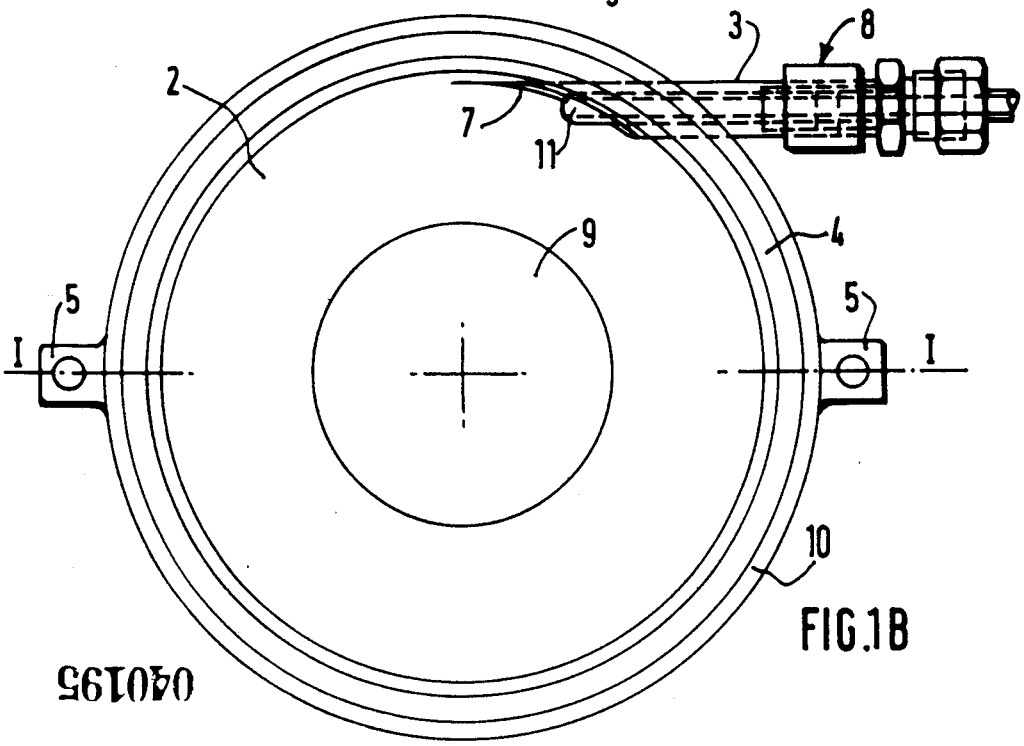

The method according to the invention and the apparatus for putting the said method into use will now be explained with reference to FIGS. 1A, 1B and 2.

Figure 2:
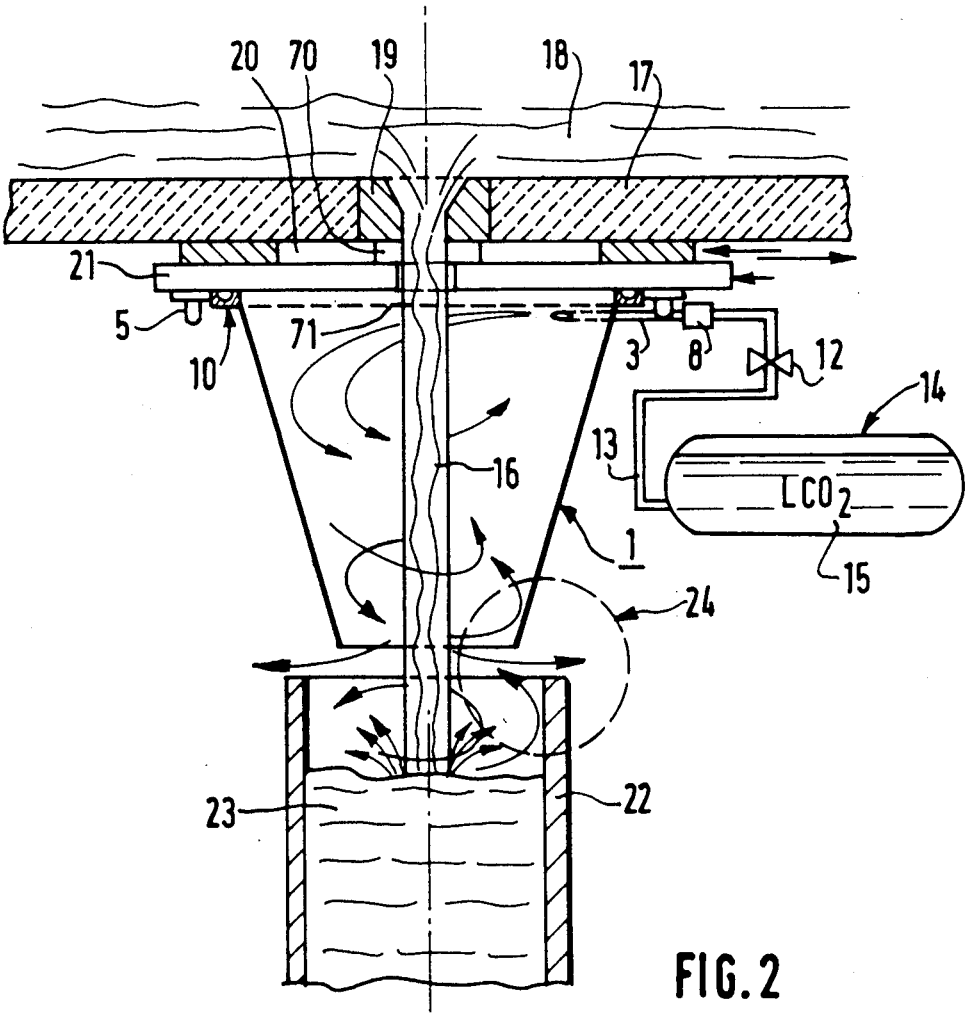
FIG. 2 is a schematic view depicting the method of the invention in the case of a continuous casting process.

As best shown in FIG. 2, the liquid metal 18, which is, for example, in a casting ladle of which only the bottom 17 has been depicted, flows through the spout 19 in a stream 16 into the oscillating ingot mold 22 to form a bath of molten metal 23. The casting ladle 17 is fitted with a closing device with plates 20, 21 which can slide over each other so that their respective openings 70 and 71 coincide with each other, enabling liquid metal to be poured into the oscillating ingot mold 22. The spout 19 is closed by sliding the plate 21 on the plate 20 or vice-versa. The cone 1 is fixed under the plate 21 by fastening lugs 5. This cone has, at its wide base, a ring 10 which surrounds the pouring stream 16 (or the hole 71) in such a way that the axis of the truncated cone 1 substantially coincides with the axis of the pouring stream 16. The ring 10 is provided with a groove 4 (FIGS. 1A and 1B) into which is fixed a seal preventing inlets of air at the plate 21 and the ring 10. The side wall 6 of the truncated cone 1 converges from its wide base 2 at the ring 10 towards its small base 9 located near the opening of the oscillating ingot mold 22. Near its wide base 2, there is a cylindrical conduit 3 (top view FIG. 1B) which opens out tangentially, the external side of the conduit 3 being substantially tangential to the circular section of the truncated cone in the median plane of the conduit, perpendicular to the axis of the truncated cone. Inside this conduit 3 is placed a nozzle 11 and a liquid carbon dioxide injector 8 by which the liquid carbon dioxide is expanded to atmospheric pressure and ambient temperature, said liquid carbon dioxide emerging through the valve 12 and the conduit 13 of the tank 14 containing liquid carbon dioxide 15. The oxygen concentration measurements, which will be given further below, are made in the zone 24 located near the pouring stream of the small base 9 of the cone 1 and the opening of the oscillating ingot mold 22.

Figure 3:
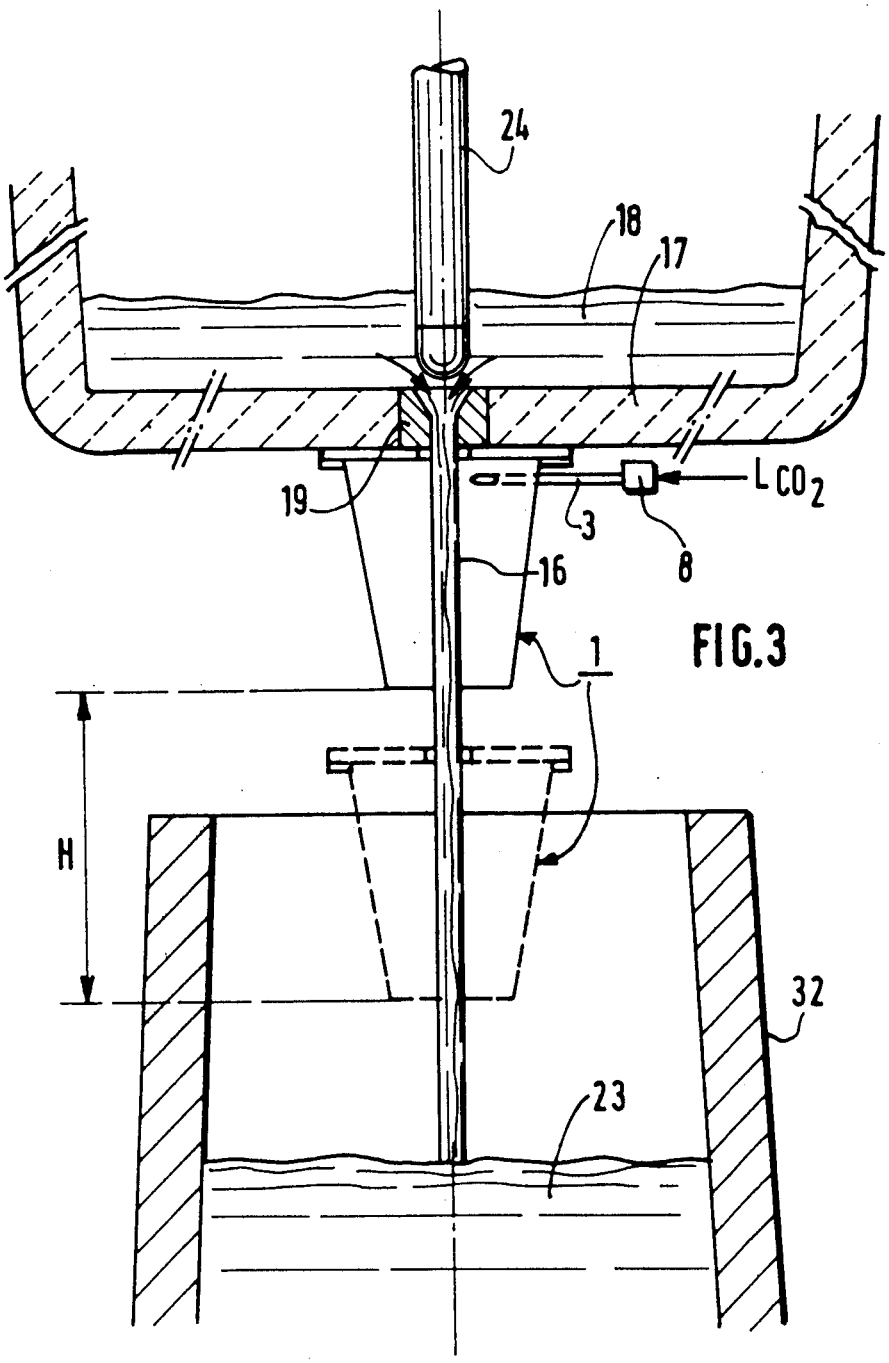
FIG. 3 is a view depicting a pouring operation, according to the invention, into an ingot mold.

FIG. 3 depicts an alternative mode of embodiment of the invention as depicted in FIG. 2, in the case of one ingot mold; in this figure, the same elements bear the same references as in the preceding figures.

In this example, the casting ladle 17 near the opening of the ingot mold 32 has been lowered at the start of the pouring operation so as to place the cone 1 in the position depicted with dashes in this figure. Before and after the pouring into the ingot mold, the ladle is raised by a height H and is in the position shown by unbroken lines in FIG. 3.

Figure 4:
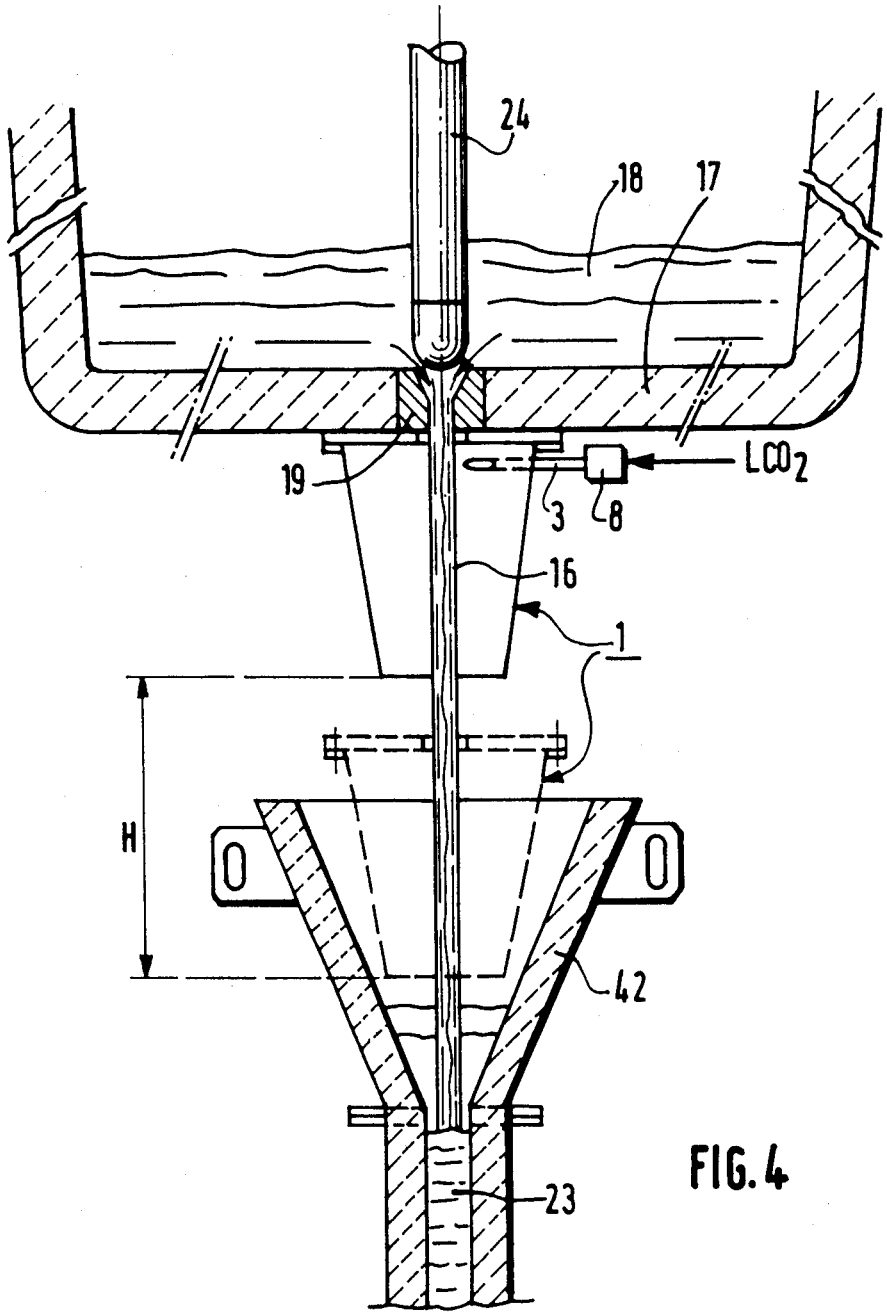
FIG. 4 is a view depicting the method according to the invention in the case of a bottom casting process.

FIG. 4 depicts an alternative embodiment of the preceding figures in the case of a so-called bottom casting process. The mode of operation is identical to that of FIG. 3, the only appreciable difference being the molten metal feeding flared element 42 which has replaced the ingot mold 32.

FIGS. 5A-5D are schematic views which help explain the method of use according to the invention, with truncated cones 1 the angles (at the vertex of the cone) of which vary. The same elements as those of the preceding figures have the same references. For an identical distance from the lower base 9 to the casting bed 31 in all the FIGS. 5A, 5B, 5C and 5D, it can easily be seen from these figures that the greater the angle of the cone, the more carbon dioxide snow and carbon dioxide gas will be created at the outlet of the truncated cone 1 have a small lower base.

Figure 5A:
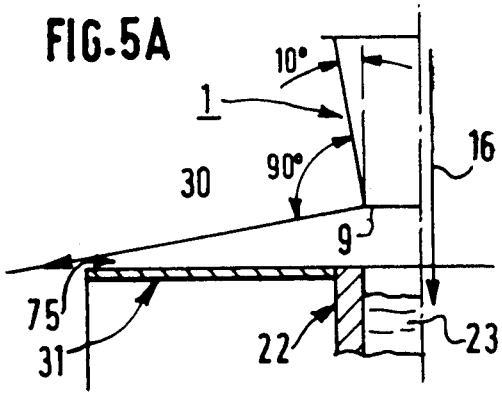
FIGS. 5A–5D are schematic views which illustrate the working of the method according to the invention.
Figure 5B:
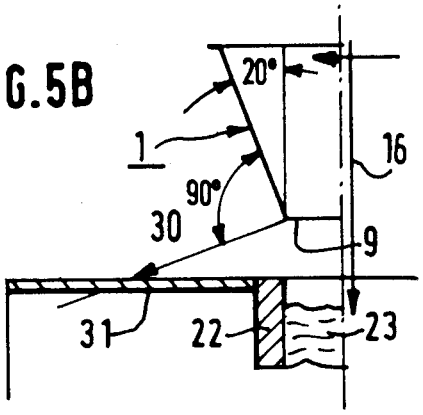
Figure 5C:
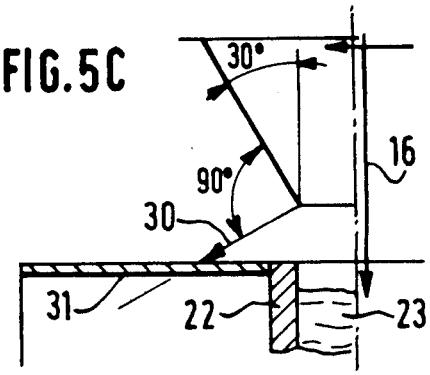

In FIG. 5A, the truncated cone 1 has an angle at the vertex which is at 10° to the vertical. Now, it has been observed that the expansion of carbon dioxide, for example stored in liquid form at 20 bars and −20° C., to ambient temperature and pressure through the expansion nozzle 11, which is known per se, makes it possible to create a cloud of carbon dioxide snow particles with a speed sufficient to surround the pouring stream 16 in a helical motion directed towards the small base of the sleeve in the shape of a truncated cone. These particles of carbon dioxide snow are gradually sublimated upon contact with the heat released by the pouring stream 16. The carbon dioxide thus created escapes through the lower end of the truncated sleeve 1 and forms a cone of shielding gas 30, the opening of which is pointed towards the second receptacle and the envelope of which is substantially perpendicular to the sheath of the truncated sleeve 1. Thus, in FIG. 5A, the cone of shielding gas 30, with an angle of about 80° at the vertex (still possibly comprising particles of carbon dioxide snow) extends beyond the end of the casting bed 31. In this case, it becomes clear that there may be air inlets at 75 and that the pouring stream 16 will not be properly shielded. It is thought that even by using very high carbon dioxide flowrates (a method that is economically prohibitive), it is not possible to achieve a right level of inerting. It would then be advisable either to bring the truncated cone closer to the casting bed (see FIG. 6B) or to take a cone with an angle of more than 10°, for example 20° or 30° as shown in FIGS. 5B and 5C. When the angle of the truncated cone becomes wide for example about 30°, it becomes necessary in such cases not to position the cone too close to the foot of the stream because the cone 30 may not have a volume sufficient to surround all the effervescence created at the foot of the stream, a point which would create inlets of air. The man skilled in the art in the light of the explanations given above, will choose the angle of the truncated cone especially according to the dimensions of the opening of the lower receptacle, the diameter of the lower base of the truncated cone, the distance from the lower base of the truncated cone 1 to the receptacle and/or the level of the molten liquid, etc. Moreover, it is generally possible to place a mask over the opening of the second receptacle if it is too wide, to remain within the area hereabove disclosed.

Figure 5D:
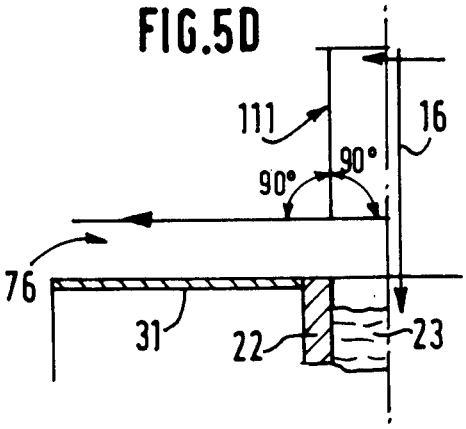

FIG. 5D illustrates a use of a cylindrical sleeve 111 along with the liquid carbon dioxide in the way described above. As explained above, it was unexpectedly observed that a cone of gas and/or carbon dioxide snow particles was formed at the outlet of the truncated cone 1, the envelope of which was substantially perpendicular to the sheath of the said truncated cone. This explains why the use of a cylindrical sleeve as depicted in FIG. 5D is not satisfactory because the cloud of gas and carbon dioxide snow particles extends in a direction which is substantially horizontal to the outlet of the cylindrical sleeve 111 and can, in no way, prevent air from entering at 76 in contact with the casting stream 16 and the liquid metal 23.

Figure 6A:
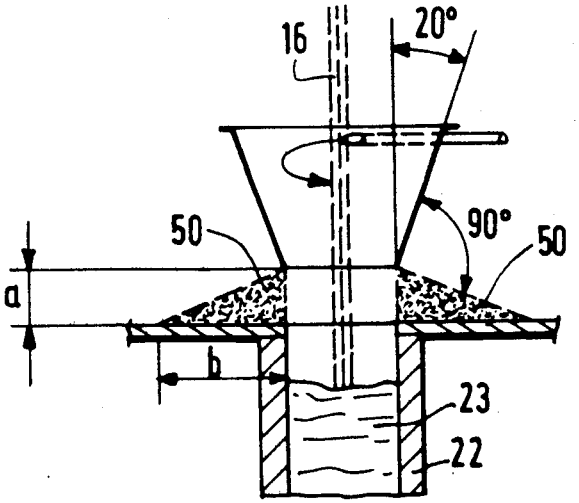
FIGS. 6A and 6B are schematic views depicting the way in which the distance between the lower base of the cone and the opening of the casting receptacle comes into play.
Figure 6B:
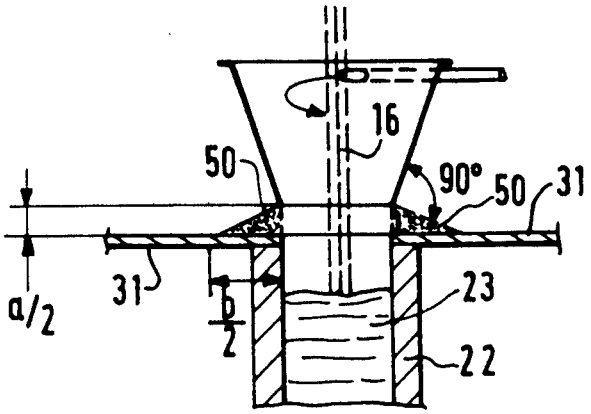

FIGS. 6A and 6B schematically depict the influence of the distance from the lower base of the truncated cone 1 to the casting table 31. When this distance a is great (in FIG. 6A about half the height of the cone 1), it is observed that the cone of shielding gas and/or carbon dioxide snow 50 extends well beyond the inlet of the oscillating ingot mold, the opening of which is, in the present case, substantially equal to the small base of the truncated cone 1. The distance between the wall of the oscillating ingot mold 22 and the periphery of the cone is represented by b and is substantially equal to the small base of the truncated cone 1 and to the height of the said cone.

In FIG. 6B, the truncated cone 1 has been brought closer to the opening of the oscillating ingot mold and is now at a distance of about a/2. As shown in FIG. 6B, the shielding cone 50 extends along a distance which is substantially equal to b/2, starting from the inner wall of the oscillating ingot mold 22.

With these indications, the man skilled in the art can easily adjust the angle at the vertex of the truncated cone and the distance from the lower base of the truncated cone to the receptacle 22 for receiving metal, it being known that the biggest dimension of the opening of the receptacle 22 will be generally smaller than the diameter of the lower base of the shielding cone 50 during a continuous casting operation in an oscillating ingot mold. During a pouring operation in a ladle or in an ingot mold, as in FIG. 3 for example, it is essential that the shielding cone of carbon dioxide snow and gas, the envelope of which is substantially perpendicular to the truncated cone, envelops the "foot of the stream", i.e. an area located around the point of impact of the stream on the surface of the liquid metal in the receptacle in which there is turbulence tending to imprison the surrounding gas in the liquid metal. It is therefore necessary that this gas should not react with the metal or, at least, that its reaction with the liquid metal, especially with steel, should be slow enough so that this reaction has not yet taken place when the degassing of the liquid metal bath takes place. This possibility defines the minimum distance from the base of the truncated cone to the opening of the said receptacle. In practice, the distance from the base of the cone to the opening of the said receptacle will be close to the minimum distance in order to reduce flows of carbon dioxide to the minimum, and will remain smaller than a distance (depending on the flow of carbon dioxide) above which the concentration in oxygen measured in the area 24 is greater than about 1%.

Among the advantages of the invention, this one especially makes it possible to carry out tests with ease. For this, it suffices to use an easily movable tank of some dozens of liters of liquid carbon dioxide in the vicinity of the pouring place, it being known that with equivalent gas flowrates higher than 0.5 $Nm^3$/minute of carbon dioxide in gaseous state it is easy to shield the process of pouring from a ladle using a single tank.

What is claimed is:

1. Method for shielding a stream of liquid metal when it is poured in a heated stream from a first receptacle into a second receptacle, the method comprising the step of surrounding the pouring stream by an envelope of shielding gas, the envelope of shielding gas being formed by expanding liquid carbon dioxide through a nozzle placed near the wide base of a truncated conical sleeve surrounding the pouring stream, the said sleeve being fastened by its wide base to the first receptacle and extending substantially to an opening of the second receptacle, the said nozzle being pointed tangentially with respect to the internal wall of the said sleeve and delivering a cloud of carbon dioxide snow particles at a speed sufficient to surround the pouring stream in a helical motion directed towards the small base of the sleeve, these carbon dioxide snow particles being gradually sublimated upon contact with heat released by the pouring stream, the carbon dioxide snow particles and the carbon dioxide gas thus created escaping through the small base of the sleeve and forming a hollow cone of shielding gas, the opening of which is pointed to the second receptacle and the envelope of which is substantially perpendicular to that of the truncated sleeve.

2. Shielding method according to claim 1, wherein the liquid metal is molten steel.

3. Shielding method according to claim 1 wherein the angle of the shielding gas cone substantially ranges from 10° to 30°.

4. Shielding method according to claim 1 wherein the flow of liquid carbon dioxide is greater than 0.5 $Nm^3$/minute of equivalent carbon dioxide gas.

5. Shielding method according to claim 1 wherein the lower part of the cone is at a distance from the opening of the lower receptable which is smaller than or equal to about 30 mm.

6. Installation for pouring liquid metal from a first receptacle to a second receptacle, the installation comprising shielding means placed beneath the first receptacle for creating a barrier of shielding gas around the stream of liquid metal escaping from the first receptacle, wherein the said shielding means comprises a truncated conical sleeve the large base of which is fixed to the first receptacle, and an injection nozzle for supplying shielding gas to the interior of the sleeve, the injection nozzle being placed in the vicinity of the said large base and pointed tangentially with respect to the internal wall of the sleeve, the said injection nozzle including means for the expansion of liquid carbon dioxide to form the shielding gas.

7. Installation according to the claim 6 further comprising a tank of liquid carbon dioxide and a conduit connected to the injection nozzle, the conduit being linked to the base of the tank in order to take off carbon dioxide in liquid form.

* * * * *